US007191566B2

(12) United States Patent
Back et al.

(10) Patent No.: US 7,191,566 B2
(45) Date of Patent: Mar. 20, 2007

(54) EAVES BEAM WITH INTERNAL DRAINAGE

(75) Inventors: Mark A. Back, Surfside Beach, SC (US); John E. Welsh, Hamilton, OH (US); J. Michael Riley, Swinton (GB)

(73) Assignee: Park Lane Conservatories Ltd. (GB)

( * ) Notice: Subject to any disclaimer, the term of this patent is extended or adjusted under 35 U.S.C. 154(b) by 74 days.

(21) Appl. No.: 10/374,874

(22) Filed: Feb. 25, 2003

(65) Prior Publication Data

US 2004/0163329 A1 Aug. 26, 2004

(51) Int. Cl.
*E04B 1/38* (2006.01)

(52) U.S. Cl. ..... 52/95; 52/302.3; 52/93.1; 52/92.1

(58) Field of Classification Search ..... 52/92, 52/90, 94, 95, 97, 200, 80, 82, 14, 15, 302.1, 52/302.6, 302.3, DIG. 17, 92.1, 93.1, 93.2, 52/223.9, 198; 47/17, 18, 485, 26; 126/430
See application file for complete search history.

(56) References Cited

U.S. PATENT DOCUMENTS 3,363,390 A 1/1968 Crane
3,456,410 A 7/1969 Olson
3,866,381 A 2/1975 Eschbach
3,916,589 A * 11/1975 Richter ..... 52/81.3
4,068,437 A 1/1978 Byxbe et al.
4,075,811 A 2/1978 Keith
4,261,143 A * 4/1981 Rizzo ..... 52/16
4,327,532 A * 5/1982 Matthews ..... 52/92.2
4,373,312 A 2/1983 Kim
4,443,508 A 4/1984 Mehl
4,455,803 A 6/1984 Kornberger
4,462,390 A * 7/1984 Holdridge et al. ..... 126/587
4,527,370 A 7/1985 Schuette
4,621,467 A 11/1986 Golden
4,928,425 A * 5/1990 Walker et al. ..... 47/18
4,970,102 A 11/1990 Guillon
5,140,768 A * 8/1992 Forbes ..... 47/17
5,215,805 A 6/1993 Pavia, Jr.
5,245,803 A * 9/1993 Haag ..... 52/90.1
5,509,250 A 4/1996 Jensen (Continued)

FOREIGN PATENT DOCUMENTS

DE 8601745.4 2/1987

(Continued)

OTHER PUBLICATIONS

Park Lane Roof Systems, *Step By Step to Installation—Victorian 5 Face*, Feb. 1996.

(Continued)

*Primary Examiner*—Naoko Slack
*Assistant Examiner*—Basil Katcheves
(74) *Attorney, Agent, or Firm*—Wood, Herron & Evans, LLP

(57) ABSTRACT

An internal drainage system for a conservatory roof which allows a conservatory to be used as dry living space. Condensation is channeled internally through the eaves beam and the supporting posts or mullions to an outlet outside of the conservatory. The condensed water is thus contained and prevented from adversely affecting the internal space of the conservatory.

23 Claims, 3 Drawing Sheets

U.S. PATENT DOCUMENTS

| | | | | |
|---|---|---|---|---|
| 5,590,492 | A * | 1/1997 | Cucchiara et al. | 52/15 |
| 5,749,197 | A | 5/1998 | Jolly | |
| 5,797,225 | A * | 8/1998 | Ishikawa | 52/93.1 |
| 6,000,176 | A | 12/1999 | Lancaster | |
| 6,119,410 | A | 9/2000 | Wolfe | |
| 6,151,845 | A | 11/2000 | Lancaster | |
| 6,185,877 | B1 * | 2/2001 | Lloyd | 52/64 |
| 6,298,619 | B1 | 10/2001 | Davie | |
| 6,584,735 | B2 * | 7/2003 | Burton | 52/95 |
| 6,647,683 | B1 * | 11/2003 | Thomsen et al. | 52/302.1 |
| 2001/0029708 | A1 | 10/2001 | Richardson | |

FOREIGN PATENT DOCUMENTS

| | | |
|---|---|---|
| EP | 0513934 | 11/1992 |
| EP | 0644305 | 3/1995 |
| GB | 2204627 | 7/1991 |
| GB | 2275948 | 9/1994 |
| GB | 2267298 | 2/1996 |
| GB | 2283997 | 1/1997 |
| GB | 2288827 | 11/1997 |
| GB | 2314875 A | 1/1998 |
| GB | 2316421 A | 2/1998 |
| GB | 2347944 | 9/2000 |

OTHER PUBLICATIONS

Park Lane Roof Systems, *Park Lane Conservatory Roofs Data Sheet*.
Park Lane Roof Systems, *Roof Vents Data Sheet*.
Park Lane Roof Systems, *Park Lane Wide Span Data Sheet*.
Park Lane Roof Systems, *Park Lane WIDE-span Assembly Instructions*, 1999.
Park Lane Roof Systems, *Prestige Data Sheet*.
Park Lane Roof Systems, *Elite Data Sheet*.
Park Lane Roof Systems, *Elite Roof Kits Data Sheet*.
Park Lane Roof Systems, *Elite Conservatory Roofing System Assembly Instructions*, Jan. 2001.
Park Lane Roof Systems, *Elite Conservatory Roofing System Brochure*.
Park Lane Roof Systems, *Step By Step Guide to Installation—Victorian 3 Face*, Feb. 1996.
Park Lane Roof Systems, *Highlight 600 Brochure*.
Park Lane Roof Systems, *Park Lane Conservatory Roof Systems Brochure*.
Park Lane Roof Systems, *Step By Step Guide to Installation—EDWARDIAN*.
Park Lane Roof Systems, *Park Lane Series II Assembly Instructions*, 1999.
Park Lane Roof Systems, *Park Lane Roof Systems Brochure*, Jul. 1995.
Park Lane Roof Systems, *Park Lane Brochure*.
Park Lane Roof Systems, *ELITE Conservatory Roofing Systems Document*.
Park Lane Roof Systems, *25° "Wide Span" Conservatories Document*.
Park Lane Roof Systems, *25° Fixed Pitch Conservatory Roof Document* .
Park Lane Roof Systems, *Park Lane Variable Pitch Conservatory Roof Document*.

* cited by examiner

EAVES BEAM WITH INTERNAL DRAINAGE

BACKGROUND OF THE INVENTION

Conservatory rooms have typically been formed from metal frames and glass or transparent plastic panels. The roofs were formed from a series of rafters which support transparent glass or weather-resistant plastic (e.g., polyvinylchloride) panels between the rafters.

Traditionally, conservatories have been thought of as enclosed patios. While being protected from the elements, they were nonetheless prone to unwelcome condensation problems. This has been due to a combination of the transparent glass or plastic used in conservatory construction, providing minimal insulating value, and the difference between the inside and outside temperature, humidity, and dew point. The problem with condensation is particularly pronounced when, as is often the case, numerous plants and other moisture-emitting sources are located in a conservatory. A pool or spa within a conservatory can cause severe condensation problems.

As steam or moist air rises, it can condense when it comes in contact with the ceiling panels, the roof rafters, and/or the eaves beam. The condensation on the metallic roof rafters and metallic eaves beam is often more pronounced than the condensation on the glass or plastic panels. As moisture condenses on the ceiling panels or roof rafters, it then flows downward along the contour of the ceiling or rafters to the eaves beam, and then will either drip to the ground or continue running down the sides of the conservatory, causing unsightly water streaks on the side window panels. Further, any water that has condensed on, or flowed down to, the eaves beam that does not run down along the sides, but rather remains on the eaves beam, can lead to harmful mold and mildew problems. Mold and mildew buildup on the eaves beam is particularly problematic in that the location of the beam tends to make cleaning it rather difficult. The water that does flow down can also begin to pool at the base of the side walls, causing damage to floor coverings, furniture, or accessories that happened to come in contact with the puddles or the sides of the conservatory. Also, cool condensed water can be particularly irritating to someone standing under the eaves beam, or leaning or sitting against a wall of the conservatory. Finally, this unwelcome condensation can also cause rust damage to metallic items it contacts, such as wall hangings or hanging baskets.

SUMMARY OF THE INVENTION

The present invention collects and channels the moisture that condenses on the rafters to prevent the problems associated with unwelcome water running down the side walls of a conservatory. The present invention accomplishes this by collecting the moisture in the eaves beam and then channeling it outside though the supporting posts. By intercepting the condensed moisture early, and preventing it from affecting the interior of the conservatory, a conservatory can become a more functional dry living space.

The objects and advantages of the present invention will be further appreciated in light of the following detailed drawings and descriptions.

DETAILED DESCRIPTION OF THE INVENTION

Figure 1:
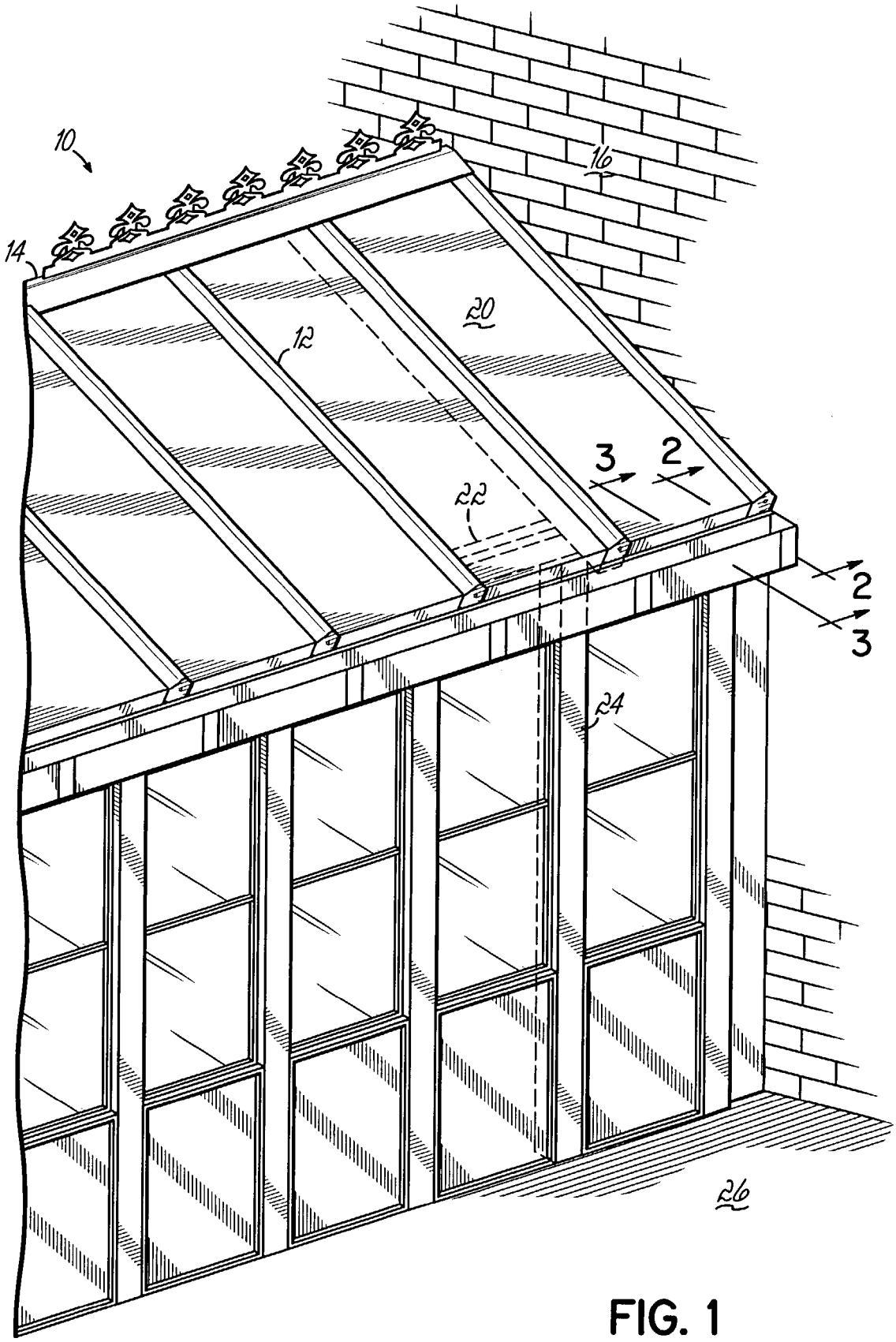
FIG. 1 is a perspective view of a conservatory roof with supporting posts according to the present invention.

As shown in FIG. 1, the present invention is a conservatory roof 10 having a plurality of rafters 12 which generally attach at an upper end to a ridge beam 14 which, as shown, extends outwardly from a wall of a house or other building 16. Rafters 12 extend from the ridge beam 14 to an eaves beam 22. Between individual rafters 12 are panels 20 which constitute the majority of the surface area of the conservatory's roof 10.

The eaves beam 22, in turn, is supported by a plurality of posts or mullions 24. The posts or mullions 24 rest upon the ground, floor, or similar foundational structure 26.

Figure 2:
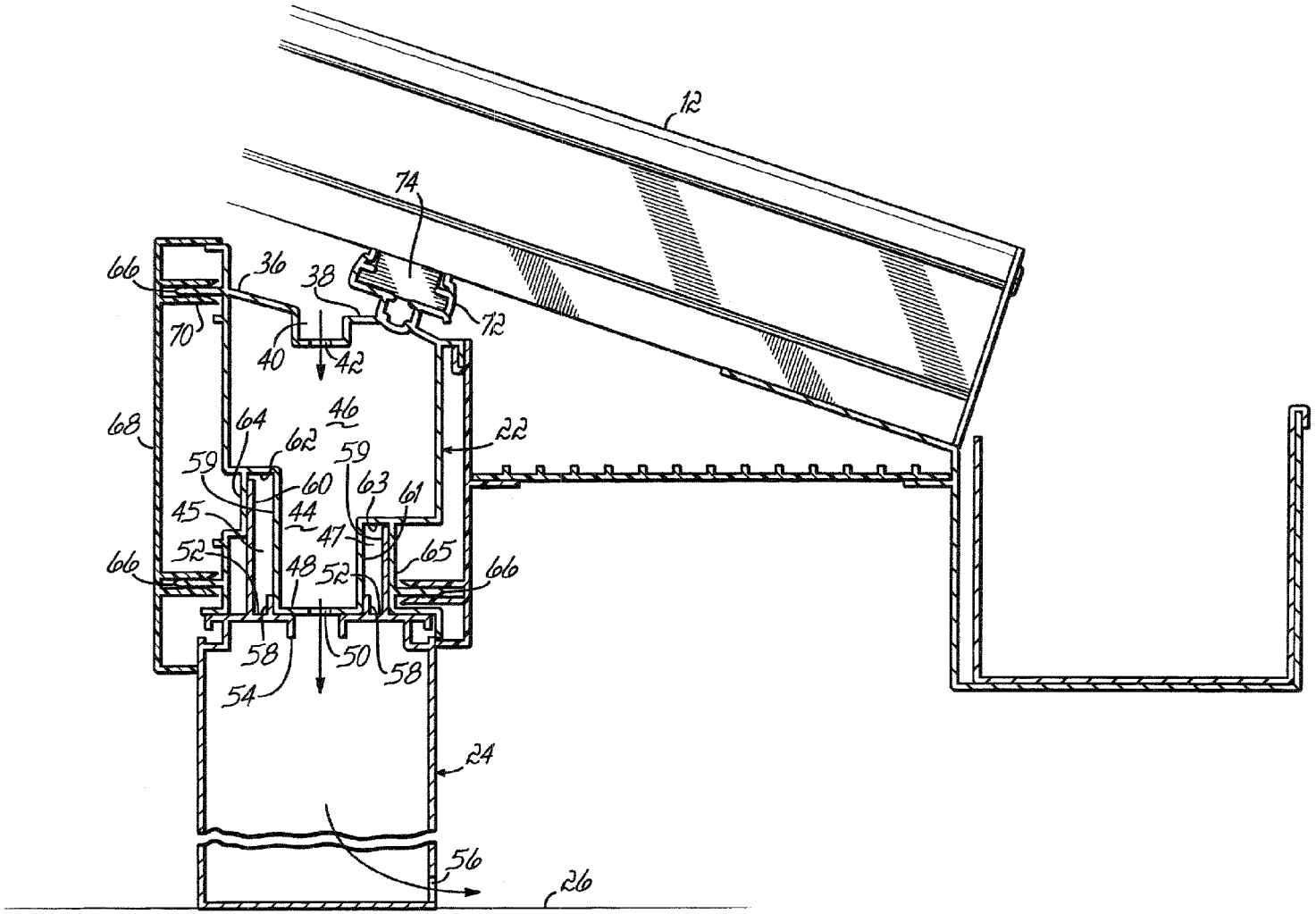
FIG. 2 is a cross-sectional view taken of lines 2—2 of FIG. 1.

As shown in FIG. 2, the posts or mullions 24 contain vertical guide tabs 58. Nested between guide tabs 58 is the lower section 44 of the eaves beam 22. The parallel guide tabs 58 are generally centrally located on the posts or mullions 24, and are separated from each other by a distance approximating the exterior width of the lower section 44 of the eaves beam 22. These guide tabs 58 prevent horizontal movement of the eaves beam 22 and act as a guide to place and attach the eaves beam 22 on the posts or mullions 24.

The lower section 44 of the eaves beam 22 includes a first and second channel 45, 47. A first part of the guide tabs 58 engages walls 59, 61 of these channels. Exteriorly of the guide tabs 58, a parallel set of tabs 60, 61 extends vertically upward from the top wall 52 of the posts or mullions 24. These tabs 60, 61 engage walls 64, 65 of channels 45, 47, centering the eaves beam 22 on the posts or mullions 24.

In the preferred embodiment, the tabs 60, 61 extend higher than the guide tabs 58 and generally to the respective levels of the bottom surfaces 62, 63 of the upper section 46 of the eaves beam 22. The tabs 60, 61 can guide and support the positioning, placement, and securement of the eaves beam 22 to the posts or mullions 24. The eaves beam 22 can be secured to the posts or mullions 24 with a screw or other suitable fastener. In the preferred embodiment, the tabs 60, 61 also include trim mounting barbs 66. An interior finishing trim plate 68 containing channel receptacles 70 can be attached to the barbs 66. In the preferred embodiment, the trim plate 68 is made from plastic and snaps onto the barbs 66.

The eaves beam 22 further contains a slopingly aligned C-bracket 72 which matches the slope of the roof 10. The C-bracket 72 holds a support member 74 which, in the preferred embodiment, is made from plastic. The rafters 12 rest on the support member 74.

Figure 3:
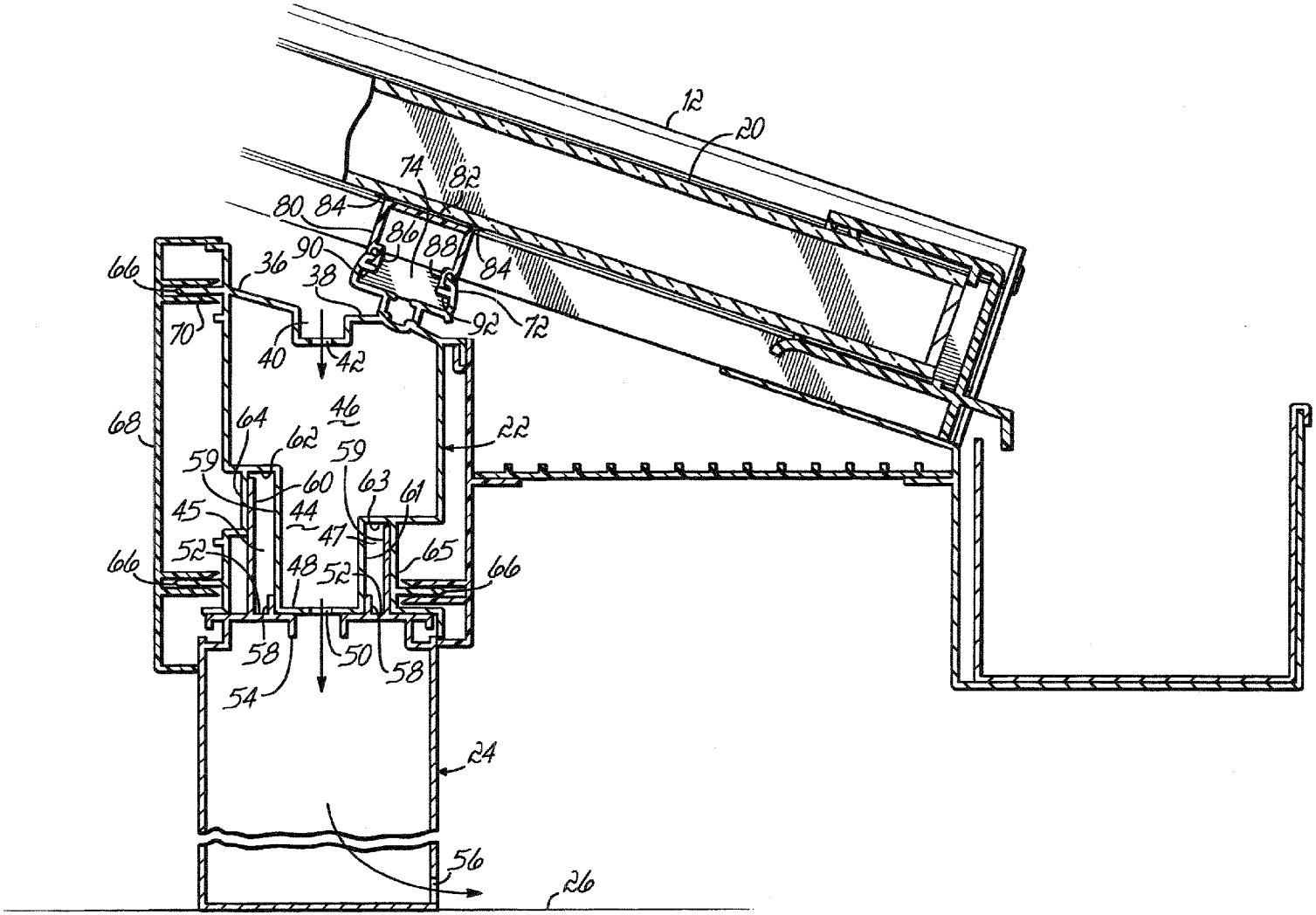
FIG. 3 is a cross-sectional view taken of lines 3—3 of FIG. 1.

As shown in FIG. 3, an opposing C-shaped channel 80 is attached to the C-bracket 72 via parallel sets of opposing coupling appendages 86, 88, 90, 92. Coupling appendages 86,88, attached to C-shaped channel 80, snap into coupling appendages 90, 92, attached to C-bracket 72, thus securing the C-shaped channel 80 to the C-bracket 72. Attached to the uppermost outside surface 82 of the C-shaped channel 80 is a pair of rubber glazing members 84. The panels 20 rest on the rubber glazing members 84.

The interior portion 36 of the top surface 38 of the eaves beam 22 is sloped away from the interior of the conservatory, facilitating the natural flow of condensed water into the groove or channel 40 of the top surface 38. This groove or channel 40 runs along the entire length of the eaves beam 22, and is thus able to collect the moisture that runs down along the rafters 12. The groove or channel 40 also contains one or more drain holes 42, which allow the accumulated water to flow interiorly downward within the eaves beam 22.

The lower section 44 of the eaves beam 22 is narrower than the upper section 46 of the eaves beam 22. This narrow lower section 44 further channels the water downward.

The bottom surface 48 of the eaves beam 22 contains one or more drain holes 50 which are positioned above the supporting posts or mullions 24 and in general vertical alignment with the drain holes 42 located in the groove or channel 40 of the eaves beam 22. This allows the water to continue flowing interiorly downward through an aperture in the top wall 52 of the posts or mullions 24. The aperture in the top wall 52 of the posts or mullions 24 includes an annular drip edge 54 extending interiorly downward from the top wall 52. An external drain hole 56 is located at or near the bottom of the posts or mullions 24. In the preferred embodiment shown, this allows the water to complete its journey by externally exiting the posts or mullions 24 and away from the conservatory. In an alternative embodiment, the drain hole 56 could be connected to a water dispersion system, such as a yard drain, or could even be routed interiorly through a similar water dispersion system, such as an interior drain.

This has been a description of the present invention and the preferred mode of practicing the invention.

What is claimed is:

1. A conservatory roof system comprising:

a plurality of posts, each having a longitudinal internal cavity and a top surface extending radially inwardly having an aperture into said internal cavity, and a drain hole from said internal cavity;

a longitudinal eaves beam, supported by said posts, having a channel along an axis of said beam, said channel having a plurality of apertures generally vertically aligned with said apertures in said posts;

a plurality of rafters supported by said eaves beam; and a plurality of panels supported by said rafters, said plurality of panels having an upper exterior side and a lower interior side, said lower interior side sloping downwardly and terminating at a point about said channel whereby condensation on said lower interior side flows across said lower interior side to said channel.

2. The conservatory roof system of claim 1 wherein said posts are cylindrical.

3. The conservatory roof system of claim 1 wherein said posts are multi-sided.

4. The conservatory roof system of claim 1 wherein said posts are metal.

5. The conservatory roof system of claim 1 wherein said eaves beam is metal.

6. The conservatory roof system of claim 1 wherein said rafters are metal.

7. The conservatory roof system of claim 1 wherein said panels are glass.

8. The conservatory roof system of claim 1 wherein said panels are plastic.

9. The conservatory roof system of claim 1 wherein said drain hole drains outside the conservatory.

10. A conservatory roof system having an internal drainage system for a conservatory comprising:

a plurality of sloped rafters having an upper exterior side and a lower interior side:

a plurality of sloped panels supported by said rafters, said panels having an upper exterior side and a lower interior side, said lower interior side of said rafters and said lower interior side of said panels adapted to facilitate the downward internal flow of condensed water along said lower interior side of said rafters and said lower interior side of said panels;

an eaves beam supporting said rafters, said beam having an upper sloped surface, a hollow internal section and a plurality of lower drain holes, said upper sloped surface of said eaves beam adapted to receive the condensed water from said lower interior side of said rafters and said lower interior side of said panels, said upper sloped surface of said eaves beam having a recessed channel along an axis of said beam, said channel adapted to collect the condensed water, said channel having a plurality of drain holes, said drain holes adapted to facilitate the flow of condensed water into said hollow internal section of said eaves beam, said lower drain holes in said eaves beam adapted to facilitate the flow of the condensed water from the internal hollow section of the eaves beam;

whereby water that internally condenses on said lower interior side of said rafters and said lower interior side of said panels is dispersed outside of said conservatory.

11. The internal drainage system of claim 10 further comprising a plurality of posts supporting said eaves beam, said posts having a top surface, a longitudinal internal cavity and a lower drain hole, said top surface having an aperture into said cavity, said aperture adapted to receive the flow of condensed water from the lower drain holes in the eaves beam and allow it to flow through said cavity and out said lower drain hole in said posts.

12. A conservatory roof system comprising:

a plurality of posts, each having a longitudinal internal cavity and a top surface extending radially inwardly having an aperture into said internal cavity, and a drain hole from said internal cavity;

a longitudinal eaves beam supported by said posts, said eaves beam having a plurality of apertures generally vertically aligned with said apertures in said posts;

a plurality of rafters supported by said eaves beam; and a plurality of panels supported by said rafters, said plurality of panels having an upper exterior side and a lower interior side, said lower interior side adapted to allow interior condensation on said lower interior side to flow across said lower interior side to said plurality of apertures in said eaves beam.

13. The conservatory roof system of claim 12 wherein said posts are metal.

14. The conservatory roof system of claim 12 wherein said eaves beam is metal.

15. The conservatory roof system of claim 12 wherein said rafters are metal.

16. The conservatory roof system of claim 12 wherein said panels are glass.

17. The conservatory roof system of claim 12 wherein said panels are plastic.

18. The conservatory roof system of claim 12 wherein said drain hole drains outside the conservatory.

19. A conservatory roof system having an internal drainage system for a conservatory comprising:

a plurality of sloped rafters having an upper exterior side and a lower interior side;

a plurality of sloped panels supported by said rafters, said panels having an upper exterior side and a lower interior side, said lower interior side of said rafters and said lower interior side of said panels adapted to facilitate the downward internal flow of condensed water along said lower interior side of said rafters and said lower interior side of said panels;

an eaves beam supporting said rafters, said beam having an upper sloped surface, a hollow internal section and a plurality of lower drain holes, said upper sloped surface of said eaves beam adapted to receive the condensed water from said lower interior side of said rafters and said lower interior side of said panels, said upper sloped surface of said eaves beam having a plurality of drain holes, said drain holes adapted to facilitate the flow of condensed water into said hollow internal section of said eaves beam, said lower drain holes in said eaves beam adapted to facilitate the flow of the condensed water from the internal hollow section of the eaves beam;

whereby water that internally condenses on said lower interior side of said rafters and said lower interior side of said panels is dispersed outside of said conservatory.

20. The internal drainage system of claim 19 further comprising a plurality of posts supporting said eaves beam, said posts having a top surface, a longitudinal internal cavity and a lower drain hole, said top surface having an aperture into said cavity, said aperture adapted to receive the flow of condensed water from the lower drain holes in the eaves beam and allow it to flow through said cavity and out said lower drain hole in said posts.

21. A system for transferring condensational moisture comprising:

a habitable structure having an interior, and an exterior, the interior having an upper altitudinal portion, wherein the interior is subject to condensable moisture levels;

a condensational moisture flow path extending generally downwardly from the upper altitudinal portion of the interior of the habitable structure to the exterior of the habitable structure, the condensational moisture flow path having an upper altitudinal portion, a middle altitudinal portion, and a lower altitudinal portion;

a sloped roof covering the habitable structure, the sloped roof having an underside, the sloped roof having a plurality of sloped panels attached to and supported by a plurality of sloped rafters, each of the sloped rafters having a plurality of planar surfaces, the sloped roof having an upper ridge portion and a lower eaves portion;

an eaves beam attached to and supporting the plurality of sloped rafters, the eaves beam having a hollow internal section, a top wall, and a plurality of other planar walls;

a slopingly aligned bracket having a slope generally matching the slope of the roof, the slopingly aligned bracket attached to and connecting the eaves beam with the plurality of sloped rafters;

a supporting member attached to and supporting the eaves beam, the supporting member positioned generally opposite the ridge portion of the sloped roof, the supporting member adapted to rest upon a foundation structure;

an interior sloped condensational surface located on the underside of the sloped roof, the interior sloped condensational surface sloping outwardly downward towards the supporting member, the condensational surface having a slope sufficient to permit the downward flow of condensation along the condensational surface, wherein the condensational surface forms at least part of the upper altitudinal portion of the condensational moisture flow path;

a downwardly sloped moisture receptacle surface positioned on the top wall of the eaves beam and below the slopingly aligned bracket, the downwardly sloped moisture receptacle surface sloping toward the exterior of the structure, wherein the downwardly sloped moisture receptacle surface forms at least part of the middle altitudinal portion of the condensational moisture flow path;

a plurality of upper entry drain holes positioned in the downwardly sloped moisture receptacle surface, the plurality of upper entry drain holes extending from the top wall of the eaves beam to the hollow internal section of the eaves beam;

a plurality of exit drain holes positioned in another planar surface of the eaves beam, the plurality of exit drain holes forming at least part of the lower altitudinal portion of the condensational moisture flow path;

wherein moisture that contacts the condensational surface condenses and forms condensation on the condensational surface, flows downward along the condensational surface, is received by the downwardly sloped moisture receptacle surface, flows through the plurality of upper entry drain holes positioned in the downwardly sloped moisture receptacle surface, into the hollow internal section of the eaves beam, and through the plurality of exit drain holes positioned in another planar surface of the eaves beam to exit the structure.

22. A conservatory roof system having an internal drainage system for a conservatory comprising:

a plurality of sloped rafters;

a plurality of sloped panels supported by said rafters, said rafters and said panels adapted to facilitate the downward internal flow of condensed water along said rafters and said panels;

an eaves beam supporting said rafters, said beam having an upper sloped surface, a hollow internal section and a plurality of lower drain holes, said upper sloped surface of said eaves beam adapted to receive the condensed water from said rafters and said panels, said upper sloped surface of said eaves beam having a recessed channel along an axis of said beam, said channel adapted to collect the condensed water, said channel having a plurality of drain holes, said drain holes adapted to facilitate the flow of condensed water into said hollow internal section of said eaves beam, said lower drain holes in said eaves beam adapted to facilitate the flow of the condensed water from the internal hollow section of the eaves beam;

a plurality of posts supporting said eaves beam, said posts having a top surface, a longitudinal internal cavity and a lower drain hole, said top surface having an aperture into said cavity, said aperture adapted to receive the flow of condensed water from the lower drain holes in the eaves beam and allow it to flow through said cavity and out said lower drain hole in said posts;

whereby water that internally condenses on said rafters and said panels is dispersed outside of said conservatory.

23. A conservatory roof system having an internal drainage system for a conservatory comprising:

a plurality of sloped rafters; a plurality of sloped panels supported by said rafters, said rafters and said panels adapted to facilitate the downward internal flow of condensed water along said rafters and said panels;

an eaves beam supporting said rafters, said beam having an upper sloped surface, a hollow internal section and a plurality of lower drain holes, said upper sloped surface of said eaves beam adapted to receive the condensed water from said rafters and said panels, said upper sloped surface of said eaves beam having a plurality of drain holes, said drain holes adapted to facilitate the flow of condensed water into said hollow internal section of said eaves beam, said lower drain holes in said eaves beam adapted to facilitate the flow of the condensed water from the internal hollow section of the eaves beam;

a plurality of posts supporting said eaves beam, said posts having a top surface, a longitudinal internal cavity and a lower drain hole, said top surface having an aperture into said cavity, said aperture adapted to receive the flow of condensed water from the lower drain holes in the eaves beam and allow it to flow through said cavity and out said lower drain hole in said posts;

whereby water that internally condenses on said rafters and said panels is dispersed outside of said conservatory.

* * * * *